US010308023B2

(12) United States Patent
Stewart

(10) Patent No.: US 10,308,023 B2
(45) Date of Patent: Jun. 4, 2019

(54) METHOD OF MAKING INKJET PRINT HEADS BY FILLING RESIDUAL SLOTTED RECESSES AND RELATED DEVICES

(71) Applicant: STMicroelectronics, Inc., Coppell, TX (US)

(72) Inventor: Kenneth J. Stewart, Coppell, TX (US)

(73) Assignee: STMICROELECTRONICS, INC., Coppell, TX (US)

( * ) Notice: Subject to any disclaimer, the term of this patent is extended or adjusted under 35 U.S.C. 154(b) by 0 days.

(21) Appl. No.: 15/664,668

(22) Filed: Jul. 31, 2017

(65) Prior Publication Data

US 2017/0326878 A1 Nov. 16, 2017

Related U.S. Application Data

(62) Division of application No. 14/985,984, filed on Dec. 31, 2015, now Pat. No. 9,744,766, which is a division of application No. 13/906,466, filed on May 31, 2013, now Pat. No. 9,409,394.

(51) Int. Cl.
*B41J 2/16* (2006.01)
*B41J 2/14* (2006.01)

(52) U.S. Cl.
CPC ..... *B41J 2/1433* (2013.01); *B41J 2/16* (2013.01); *B41J 2/1635* (2013.01); *B41J 2202/20* (2013.01)

(58) Field of Classification Search
CPC ..... B41J 2/16; B41J 2/1635; B41J 2/1433
See application file for complete search history.

(56) References Cited

U.S. PATENT DOCUMENTS

| | | | |
|---|---|---|---|
| 4,417,251 | A | 11/1983 | Sugitani |
| 5,680,702 | A | 10/1997 | Kataoka |
| 5,818,481 | A | 10/1998 | Hotomi et al. |
| 6,328,420 | B1 | 12/2001 | Koyama et al. |
| 6,668,453 | B1 | 12/2003 | Shibata |
| 6,672,712 | B1 | 1/2004 | Donaldson et al. |
| 6,911,155 | B2 | 6/2005 | Miller et al. |
| 7,051,426 | B2 | 5/2006 | Buswell |
| 7,326,356 | B2 | 2/2008 | Bresciani et al. |
| 7,482,701 | B2 | 1/2009 | Ito et al. |
| 7,802,868 | B2 | 9/2010 | Ohta |
| 7,905,197 | B2 | 3/2011 | Pan |
| 8,206,535 | B2 | 6/2012 | Keenan et al. |
| 8,510,948 | B2 | 8/2013 | Buswell et al. |

(Continued)

*Primary Examiner* — Lamson D Nguyen
(74) *Attorney, Agent, or Firm* — Slater Matsil, LLP

(57) ABSTRACT

An inkjet print head includes a semiconductor substrate having a plurality of continuous slotted recesses in a first surface. The plurality of continuous slotted recesses is arranged in parallel, spaced apart relation. Each continuous slotted recess extends continuously across the first surface. The semiconductor substrate also has a plurality of discontinuous slotted recesses in a second surface that is opposite the first surface. The plurality of discontinuous slotted recesses is aligned and coupled in communication with the continuous slotted recesses to have a first portion defining a plurality of alternating through-wafer channels and a second portion defining residual slotted recess portions. A dielectric material is disposed within the residual slotted recess portions. A plurality of inkjet heaters is carried by said semiconductor substrate.

20 Claims, 8 Drawing Sheets

(56) References Cited

U.S. PATENT DOCUMENTS

| | | | |
|---|---|---|---|
| 8,596,757 | B2 | 12/2013 | Koseki |
| 9,409,394 | B2 | 8/2016 | Stewart |
| 9,744,766 | B2 * | 8/2017 | Stewart ..... B41J 2/16 |
| 2001/0055053 | A1 | 12/2001 | Kataoka et al. |
| 2002/0180825 | A1 | 12/2002 | Buswell et al. |
| 2003/0140496 | A1 | 7/2003 | Buswell et al. |
| 2003/0140497 | A1 | 7/2003 | Rivas et al. |
| 2003/0164355 | A1 | 9/2003 | Park |
| 2003/0193550 | A1 | 10/2003 | Harajiri et al. |
| 2004/0055145 | A1 | 3/2004 | Buswell |
| 2005/0211236 | A1 | 9/2005 | Akram et al. |
| 2006/0071972 | A1 | 4/2006 | Sakamoto et al. |
| 2006/0139409 | A1 | 6/2006 | Matsushita et al. |
| 2006/0213955 | A1 | 9/2006 | Watanabe |
| 2008/0194060 | A1 | 8/2008 | Shimanuki |
| 2009/0009564 | A1 | 1/2009 | Yamazaki |
| 2013/0002766 | A1 | 1/2013 | Koseki |
| 2013/0187986 | A1 | 7/2013 | Koseki |
| 2013/0206723 | A1 | 8/2013 | Watanabe et al. |
| 2014/0118440 | A1 | 5/2014 | Kubota |
| 2016/0114583 | A1 | 4/2016 | Stewart |

* cited by examiner

METHOD OF MAKING INKJET PRINT HEADS BY FILLING RESIDUAL SLOTTED RECESSES AND RELATED DEVICES

CROSS-REFERENCE TO RELATED APPLICATIONS

This application is a divisional of U.S. application Ser. No. 14/985,984 filed on Dec. 31, 2015, which is a divisional of U.S. application Ser. No. 13/906,466 filed on May 31, 2013, now issued as U.S. Pat. No. 9,409,394 on Aug. 9, 2016, which applications are hereby incorporated herein by reference.

TECHNICAL FIELD

The present invention relates to inkjet printers, and more particularly, to methods of making inkjet print heads.

BACKGROUND

Modern ink jet printers may produce photographic-quality images. An inkjet printer includes a number of orifices or nozzles spatially positioned in a printer cartridge. Ink is heated when an electrical pulse energizes a resistive element forming a thermal resistor. The ink resting above the thermal resistor is ejected through the orifice towards a printing medium, such as an underlying sheet of paper as a result of the applied electrical pulse.

The thermal resistor is typically formed as a thin film resistive material on a semiconductor substrate as part of a semiconductor chip, for example. Several thin film layers may be formed on the semiconductor chip, including a dielectric layer carried by the substrate, a resistive layer forming the thermal resistor, and an electrode layer that defines electrodes coupled to the resistive layer to which the pulse is applied to heat the thermal resistor and vaporize the ink.

A first phase of making a print head, which may include the components described above, may follow standard semiconductor processing techniques to form circuitry for controlling the inkjet print head. The control circuitry may be formed on a front side of a silicon wafer, for example, a silicon wafer having a <100>crystalline orientation and 675-725 micron thickness.

Once the circuit formation processing steps are completed, two additional phases for making a print head are typically followed. These phases are generally classified as micro electro-mechanical systems (MEMS) processing steps. One of these MEMS phases may include forming three-dimensional structures that function as inkjet chambers, which may be formed on the same side of the wafer as the control circuitry. The thermal resistor or heater, which is described above, may be carried by a floor of each inkjet chamber. Each inkjet chamber acts as a small room into which ink flows. A roof of each inkjet chamber typically includes an opening, which may be referred to as an orifice, bore, or nozzle plate, for example.

The other MEMS processing phase may include forming through-wafer ink channels to allow ink to flow from a reservoir or supply at the backside of the wafer to each inkjet chamber. This MEMS phase may be relatively expensive. For example, one method of forming the through-wafer ink channels is deep reactive ion etching (DRIE) of silicon, which uses relatively expensive equipment and has a very low throughput. Another common method is laser cutting, which also uses relatively expensive equipment and has a very low throughput.

One technique for forming a through-wafer ink channel includes forming an ink feed slot in a substrate using a saw. More particularly, U.S. Pat. No. 7,966,728 to Buswell discloses using a circular cutting disk or saw positioned above a first surface of a substrate to cut a desired depth of the substrate.

SUMMARY

A method of making a plurality of inkjet print heads may include forming, by sawing with a rotary saw blade, a plurality of continuous slotted recesses in a first surface of a wafer. The plurality of continuous slotted recesses may be arranged in parallel, spaced apart relation, and each continuous slotted recess may extend continuously across the first surface. The method may further include forming a plurality of discontinuous slotted recesses in a second surface of the wafer to be aligned and coupled in communication with the continuous slotted recesses to define a plurality of alternating through-wafer channels and residual slotted recess portions. The method may further include selectively filling the residual slotted recess portions to define a plurality of through-wafer ink channels. Accordingly, the inkjet print heads may be made more efficiently and with a reduced cost.

Forming the plurality of continuous slotted recesses may include forming the plurality of continuous slotted recesses before forming the plurality of discontinuous slotted recesses. In other embodiments, forming the plurality of discontinuous slotted recesses may include forming the plurality of discontinuous slotted recesses before forming the plurality of continuous slotted recesses.

Forming the plurality of discontinuous slotted recesses may include etching the plurality of discontinuous slotted recesses, for example. The method may further include forming a plurality of inkjet heaters and control circuitry on the wafer.

The method may further include forming at least one layer on the wafer to define a plurality of inkjet chambers. The at least one layer may have a plurality of inkjet orifices formed therein.

Filling may include filling with a dielectric material. The dielectric material may include a polymer, for example. The wafer may further include a silicon wafer.

A device aspect is directed to an inkjet print head that may include a silicon substrate having a plurality of continuous slotted recesses in a first surface. The plurality of continuous slotted recesses may be arranged in parallel, spaced apart relation, and each continuous slotted recess may extend continuously across the first surface. The silicon substrate may also have a plurality of discontinuous slotted recesses in a second surface aligned, and coupled in communication with the continuous slotted recesses to define a plurality of alternating through-wafer channels and residual slotted recess portions. The inkjet print head may also include a dielectric material filling the residual slotted recess portions to define a plurality of through-wafer ink channels.

DETAILED DESCRIPTION OF ILLUSTRATIVE EMBODIMENTS

The embodiments will now be described more fully hereinafter with reference to the accompanying drawings, in which preferred embodiments are shown. The embodiments may, however, be in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout and prime notation is used to describe like elements in different embodiments.

Figure 1:
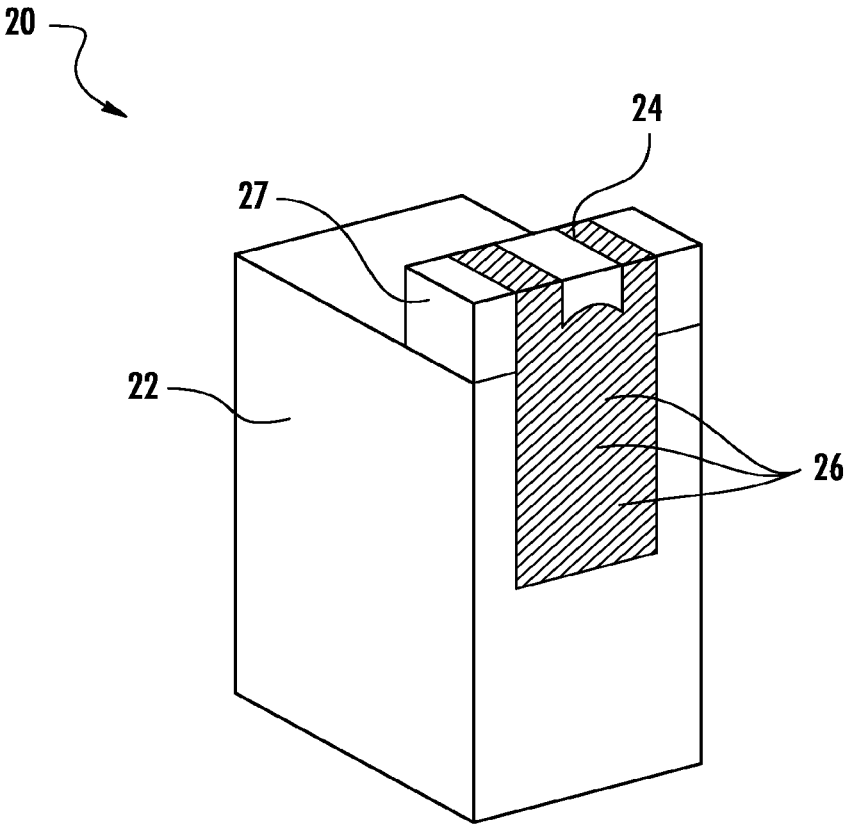
FIG. 1 is a perspective view of an inkjet print head cartridge that incorporates an inkjet print head made according to the invention.

Referring initially to FIG. 1, an inkjet print head cartridge 20 is now described. This inkjet print cartridge 20 includes a cartridge body 22 that includes ink, for example, for an inkjet print head. The ink is channeled from an ink supply through through-wafer ink channels into a plurality of inkjet chambers, each associated with a respective orifice 24 or print head nozzle positioned on the body 22 and configured to eject ink onto the paper or other print media. Electrical signals are provided to conductive traces 26 to energize thermal resistors of heater that heat the ink and eject a droplet of ink through an associated orifice 24.

The orifices 24 are typically located at an inkjet print head 27 of the print head cartridge 20. In an example, the print head cartridge 20 may include 300 or more orifices 24, each orifice 24 having an associated inkjet chamber 30, as will be appreciated by those skilled in the art. During manufacture, many print heads 27 may be formed to be included on a single silicon wafer and separated. Such methods of making inkjet print heads are described in further detail below.

Figure 2:
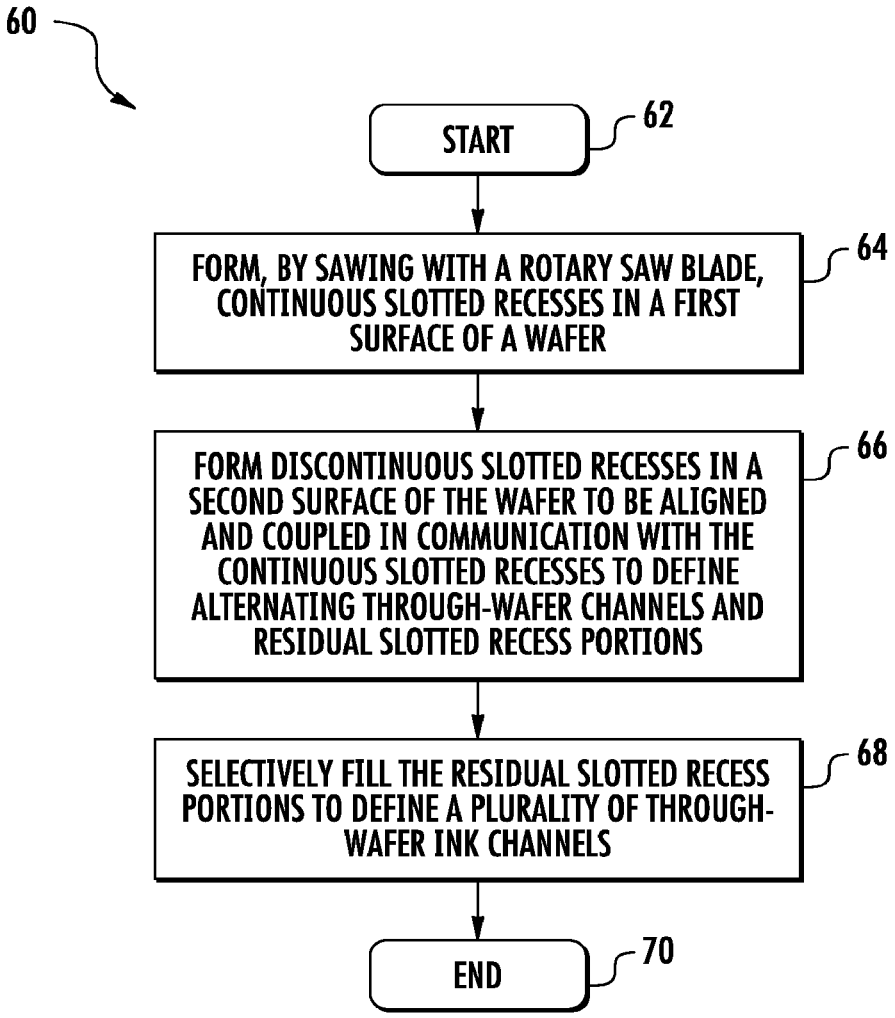
FIG. 2 is a flowchart of a method of making inkjet print heads in accordance with the invention.
Figure 3:
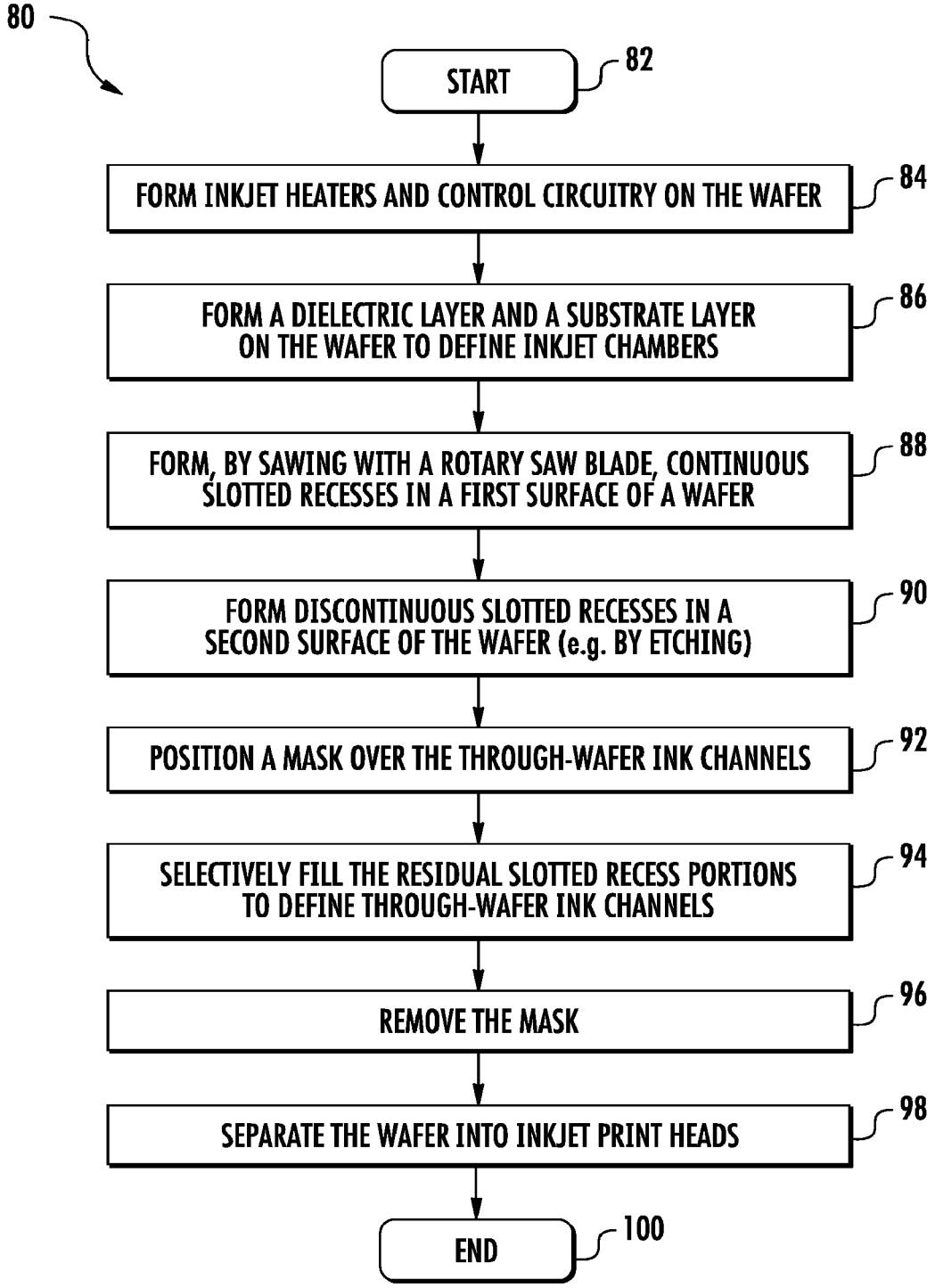
FIG. 3 is a more detailed flowchart of a method of making inkjet print heads in accordance with the invention.

Referring now to the flowchart 60 in FIG. 2, a method of making inkjet print heads 27 is described. Beginning at Block 62, the method includes, at Block 64, forming, by sawing with a rotary saw blade, continuous slotted recesses in a first surface of a wafer. The continuous slotted recesses are arranged in parallel, spaced apart relation, and each continuous slotted recess extends continuously across the first surface.

Figure 10:
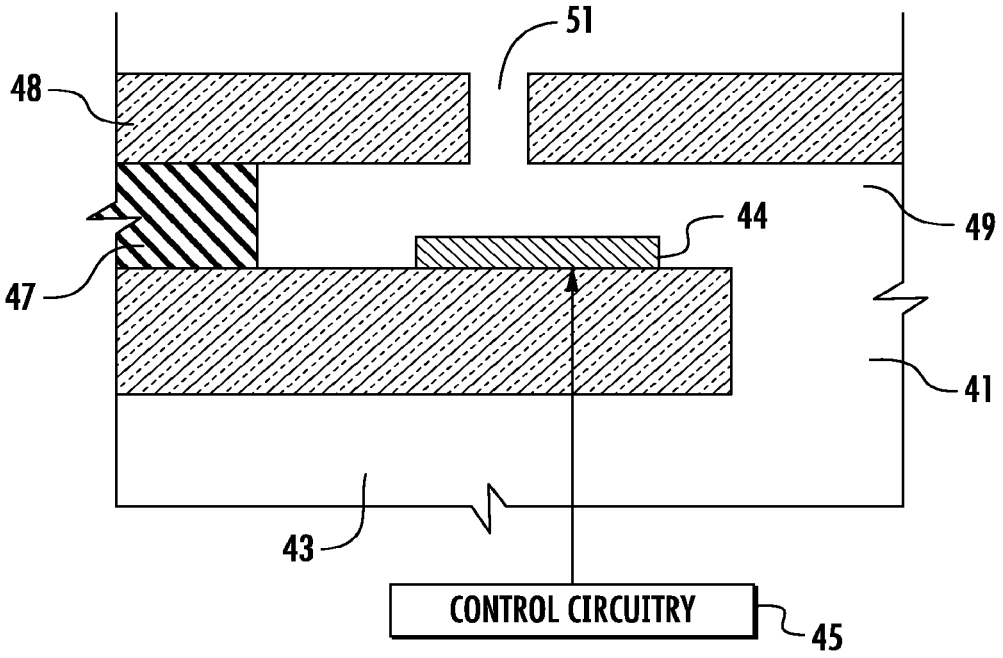
FIG. 10 is an enlarged schematic cross-sectional view of a inkjet print head according to the invention.

At Block 66, the method includes forming discontinuous slotted recesses in a second surface of the wafer to be aligned and coupled in communication with the continuous slotted recesses to define alternating through-wafer channels and residual continuous slotted recess portions. The method further includes, at Block 68, selectively filling the residual continuous slotted recess portions to define a plurality of through-wafer ink channels 41 (FIG. 10). The method ends at Block 70.

Referring now to the flowchart 80 in FIG. 3 and FIGS. 4-10, a more detailed method of making inkjet print heads 27 is now described. Beginning at Block 82, the method includes, at Block 84, forming inkjet heaters 44 and control circuitry 45 on the wafer 30 (FIG. 10). It will be appreciated by those skilled in the art that the wafer 30 includes many inkjet print heads 27, however, for ease of description, a portion of a single inkjet print head is illustrated in FIG. 10. In other words, the inkjet heaters 44 and the control circuitry 45 are formed for each inkjet print head 27 on the wafer 30.

Figure 5:
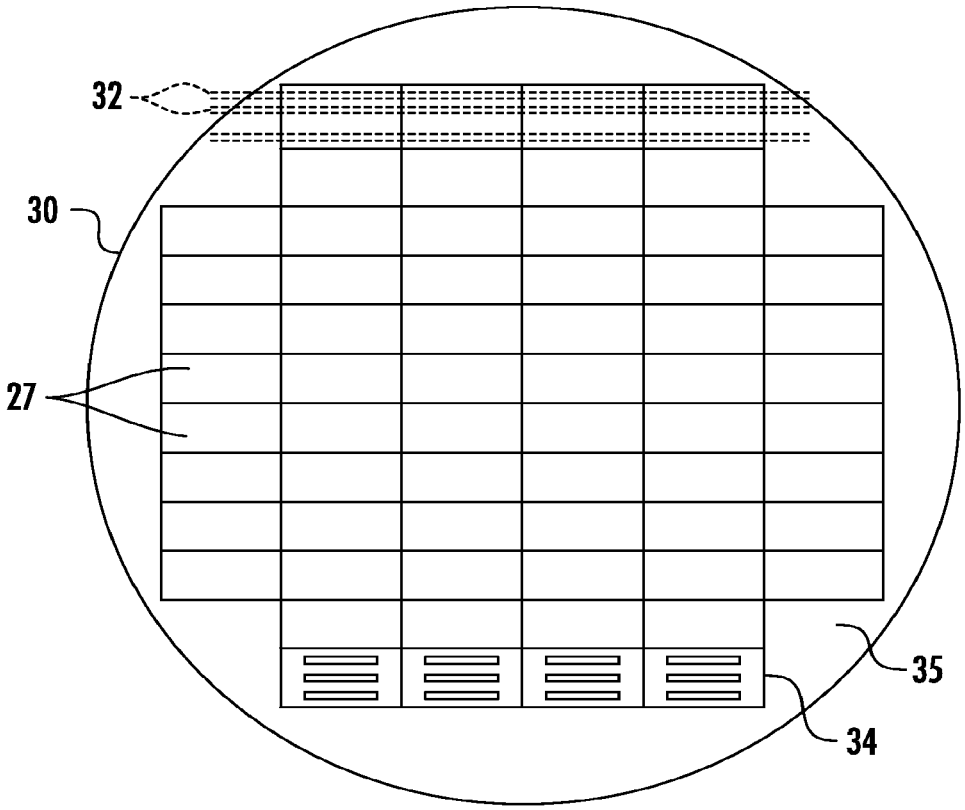
FIG. 5 is a top view of a second surface of a wafer in accordance with the invention.

The method also includes forming, at Block 86, a dielectric layer 47 and a substrate layer 48 on the wafer 30 to define inkjet chambers 49 . In some embodiments, a single silicon substrate (i.e., layer) or second wafer may be formed on the wafer 30 to define the inkjet chambers 49. The substrate layer 48 has inkjet orifices 51 formed therein. Again, while a portion of a single inkjet print head 27 is illustrated, it will be appreciated by those skilled in the art that the wafer 30 includes many inkjet print heads 27 as illustrated in FIG. 5.

Figure 4:
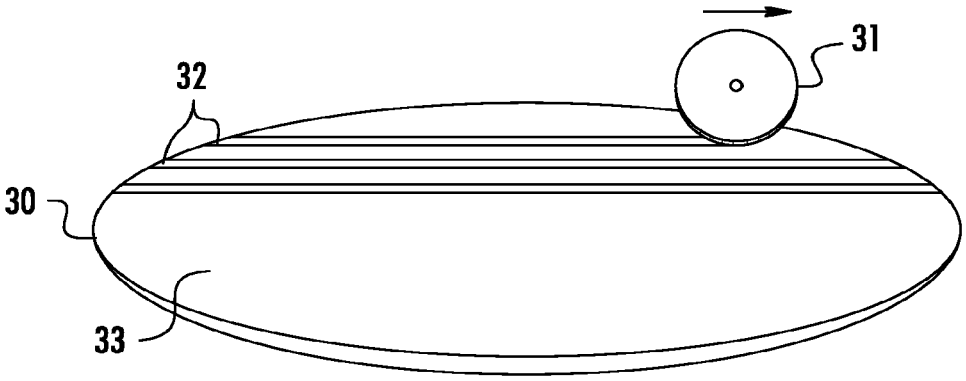
FIG. 4 is a diagram illustrating sawing continuous slotted recesses in a first surface of a wafer in accordance with the invention.

At Block 88, the method includes forming, by sawing with a rotary saw blade 31, continuous slotted recesses 32 in a first surface 33 of a wafer 30 (FIG. 4). More particularly, the continuous slotted recesses 32 may be sawed with a diamond saw, for example, similar to a diamond saw used for wafer dicing. For example, a 675 micron thick wafer may be cut such that the remaining wafer has a thickness in the range of 50-200 microns. In other words, each continuous slotted recess 32 may be formed to have a depth of between 50%-95% of a thickness of the wafer 30, for example.

The wafer 30 may be a silicon wafer or in some embodiments, a silicon substrate, for example. The continuous slotted recesses 32 are arranged in parallel, spaced apart relation. Each continuous slotted recess 32 extends continuously across the first surface 33 (FIG. 4).

At Block 90, the method includes forming discontinuous slotted recesses 34 in a second surface 35 of the wafer 30 by etching. For example, the discontinuous slotted recesses 34 may be formed in the second surface 35 by a wet or dry or reactive ion etching, plasma etching, abrasive jet erosion, etc. Of course, the discontinuous slotted recesses 34 may be formed by other techniques.

Figure 7:
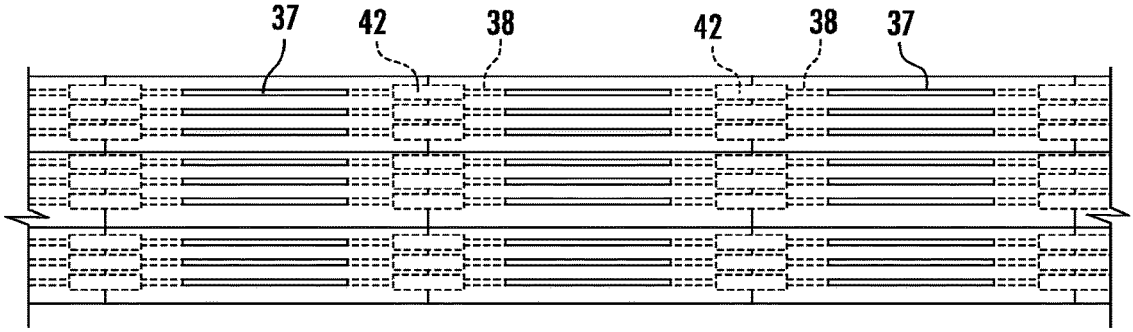
FIG. 7 is an enlarged top view of a portion of the wafer of FIG. 6 after filling the residual continuous slotted recesses with a dielectric material and removing the mask according the invention.

The discontinuous slotted recesses 34 are formed to be aligned and coupled in communication with the continuous slotted recesses 32 to define alternating through-wafer channels 37 and residual slotted recess portions 38 (FIG. 7). In other words, the continuous slotted recesses 32 are formed before the discontinuous slotted recesses 34.

Figure 6:
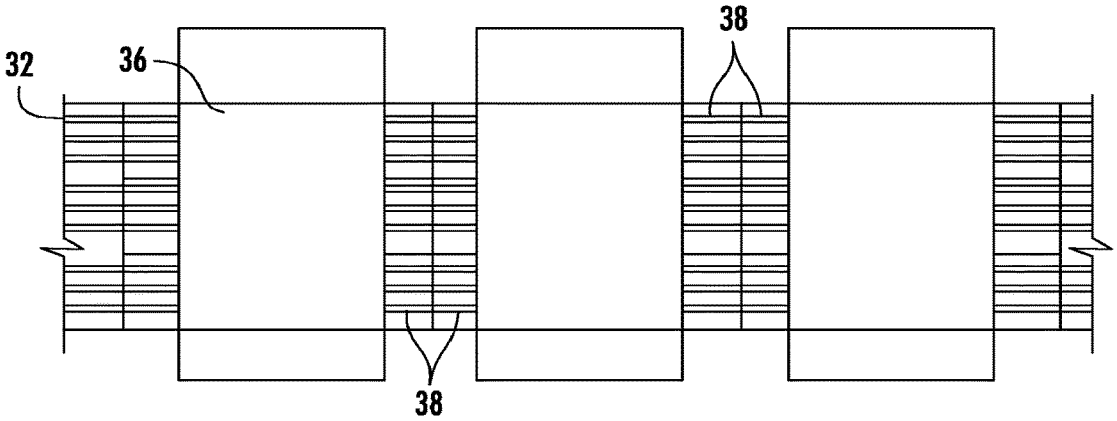
FIG. 6 is an enlarged top view of a portion of a second surface of a wafer having masked through wafer channels according to the invention.
Figure 8:
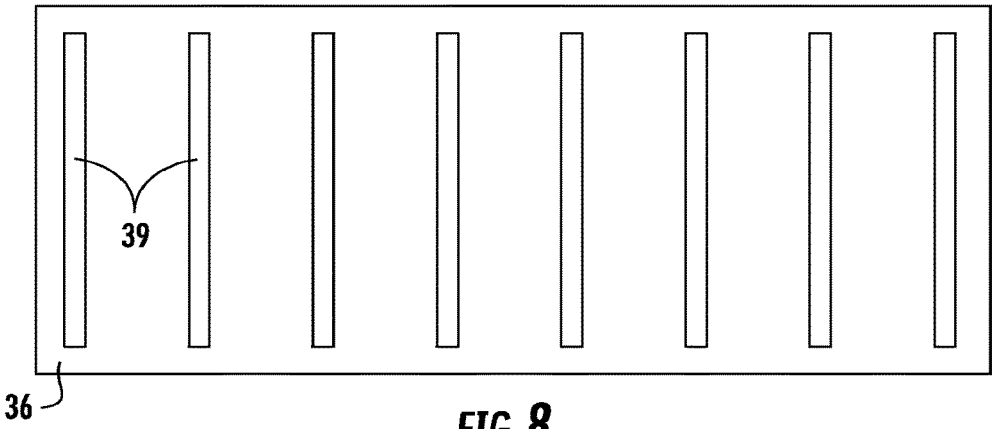
FIG. 8 is a top view of a mask according to the invention.

The method includes, at Block 92, positioning a mask 36 over the through-wafer channels 37 (FIG. 6). The mask 36 may be in the form of a frame for example, that has slots 39 that expose the residual slotted recess portions 38 (FIG. 8). Of course, in some embodiments, a mask 36 may not be used.

Figure 9:
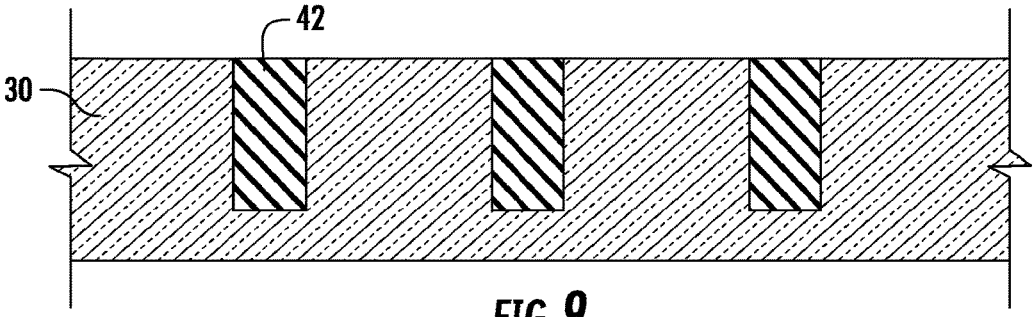
FIG. 9 is an enlarged cross-sectional view of a portion of a wafer with dielectric material filling the residual continuous slotted recess portions according to the invention.

The method further includes selectively filling the residual slotted recess portions 38 to define through-wafer ink channels 41 (Block 94 and FIG. 10). The residual slotted recess portions 38 may be filled with a dielectric material 42, for example, a polymer (FIG. 9). The dielectric material 42 may be chosen based upon its properties, for example, cost, ease of application, flow/fill, cure temperature, coefficient of thermal expansion, outgassing, toxicity, etc. The residual continuous slotted recess portions 38 may be fully filled or may be only partially filled.

As will be appreciated by those skilled in the art, the sawing reduces the overall strength of the wafer 30. Filling the residual slotted recess portions 38 with the dielectric material advantageously strengthens the wafer 40.

The through-wafer ink channels 41 are to be coupled to an ink supply 43, as will be appreciated by those skilled in the art (FIG. 10). At Block 96, the mask 36 is removed, and in some embodiments, excess dielectric material may also be removed.

The cured polymer advantageously becomes part of the inkjet print head 27. Moreover, by filling the residual slotted recess portions 38, the wafer 30 may have increased strength, and may allow for easier processing of subsequent method steps, for example. It should be noted that for ease of explanation, FIGS. 4-9 do not illustrate the inkjet 45 and control circuitry 46, as these may be formed prior to the sawing.

At Block 98, the wafer 30 is separated into inkjet print heads 27, for example, using silicon wafer dicing techniques as will be appreciated by those skilled in the art. The method ends at Block 100.

Figure 11:
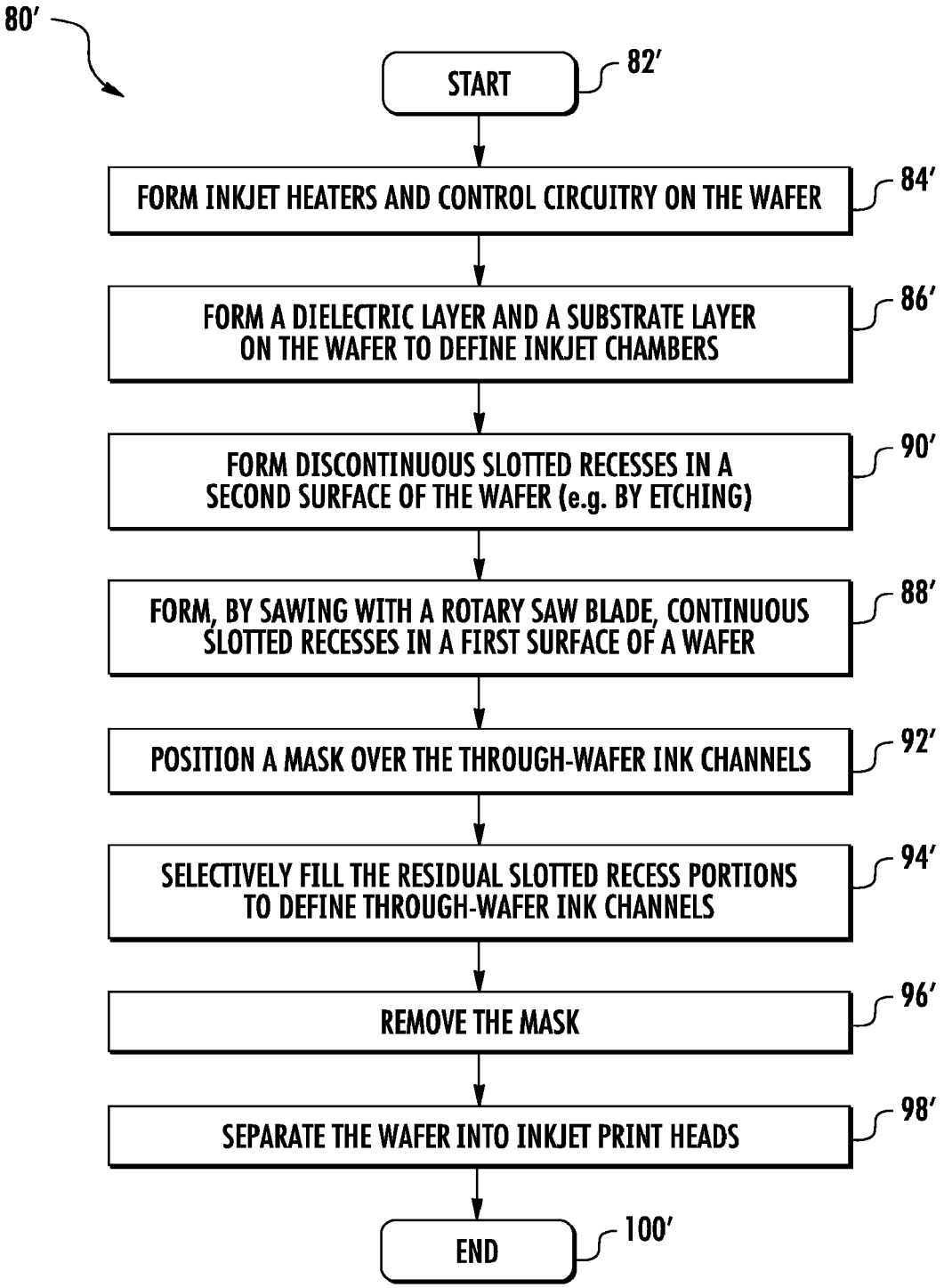
FIG. 11 is flowchart of a method of making inkjet print heads according to another embodiment of the invention.

Referring now to the flowchart 80' in FIG. 11, in another embodiment the discontinuous slotted recesses 34' are formed (Block 90') before forming the continuous slotted recesses 32' (Block 88'). The other method steps are similar to those described above with respect to the flowchart 80 in FIG. 3 and require no further discussion herein.

Many modifications and other embodiments will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

What is claimed is:

1. An inkjet print head comprising:

a semiconductor substrate having a plurality of continuous slotted recesses in a first surface, the plurality of continuous slotted recesses being arranged in parallel, spaced apart relation, and each continuous slotted recess extending continuously across the first surface, said semiconductor substrate also having a plurality of discontinuous slotted recesses in a second surface opposite the first surface and aligned and coupled in communication with the continuous slotted recesses to have a first portion defining a plurality of alternating through-wafer channels and a second portion defining residual slotted recess portions;

a dielectric material within the residual slotted recess portions; and a plurality of inkjet heaters carried by said semiconductor substrate.

2. The inkjet print head of claim 1, further comprising at least one layer on the semiconductor substrate to define a plurality of inkjet chambers.

3. The inkjet print head of claim 2, wherein the at least one layer has a plurality of inkjet orifices formed therein.

4. The inkjet print head of claim 1, comprising control circuitry coupled to said plurality of inkjet heaters.

5. The inkjet print head of claim 1, wherein each inkjet heater comprises a resistor.

6. An inkjet print head comprising:

a semiconductor substrate having a plurality of continuous slotted recesses in a first surface, the plurality of continuous slotted recesses being arranged in parallel, spaced apart relation, and each continuous slotted recess extending continuously across the first surface, said semiconductor substrate also having a plurality of discontinuous slotted recesses in a second surface opposite the first surface and aligned and coupled in communication with the continuous slotted recesses to have a first portion defining a plurality of alternating through-wafer channels and a second portion defining residual slotted recess portions;

a polymer material within the residual slotted recess portions; and a plurality of inkjet heaters carried by said semiconductor substrate.

7. The inkjet print head of claim 6, further comprising at least one layer on the semiconductor substrate to define a plurality of inkjet chambers.

8. The inkjet print head of claim 7, wherein the at least one layer has a plurality of inkjet orifices formed therein.

9. The inkjet print head of claim 6, comprising control circuitry coupled to said plurality of inkjet heaters.

10. The inkjet print head of claim 6, wherein each inkjet heater comprises a resistor.

11. An inkjet print head comprising:

a semiconductor substrate comprising a first recess at a first surface, where the first recess extends continuously across the first surface, a second recess at a second surface opposite to the first surface, the second recess overlapping with the first recess, the first recess being connected to the second recess to form a first portion comprising a first through substrate channel and a second portion comprising a first residual recess;

a polymer material disposed in the first residual recess; and a first inkjet heater proximate the first portion.

12. The inkjet print head of claim 11, further comprising control circuitry coupled to the first inkjet heater.

13. The inkjet print head of claim 12, further comprising a conductive trace coupled between the control circuitry and the first inkjet heater.

14. The inkjet print head of claim 11, wherein the first inkjet heater comprises a resistor.

15. The inkjet print head of claim 11, wherein the semiconductor substrate further comprises:

a third recess at the first surface, where the third recess extends continuously across the first surface, a fourth recess at a second surface opposite to the first surface, the fourth recess overlapping with the third recess, the third recess being connected to the fourth recess to form a third portion comprising a second through substrate channel and a fourth portion comprising a second residual recess, wherein the polymer material is disposed in the second residual recess.

16. The inkjet print head of claim 15, further comprising a second inkjet heater proximate the third portion.

17. The inkjet print head of claim 15, wherein the first portion is parallel to the third portion.

18. The inkjet print head of claim 15, further comprising a second semiconductor substrate disposed over the first surface to define a first inkjet chamber.

19. The inkjet print head of claim 18, wherein the second semiconductor substrate comprises an orifice.

20. The inkjet print head of claim 15, wherein the semiconductor substrate further comprises a layer to define a first inkjet chamber, the layer comprising an orifice.

* * * * *